United States Patent [19]

Patel et al.

[11] 4,328,259

[45] May 4, 1982

[54] PROCESS OF PRINTING BY IMPACT AND FOR MARKING AREAS WHERE IMPACT OR PRESSURE IS APPLIED

[75] Inventors: Gordhanbhai N. Patel; Ray H. Baughman, both of Morris Plains, N.J.

[73] Assignee: Allied Corporation, Morristown, N.J.

[21] Appl. No.: 200,674

[22] Filed: Oct. 27, 1980

[51] Int. Cl.[3] ..... B05D 3/06

[52] U.S. Cl. ..... 427/44; 400/127; 427/36; 427/54.1; 427/146; 427/369; 427/385.5; 427/391; 428/127

[58] Field of Search ..... 427/146, 44, 385.5, 427/391, 54.1, 36, 288; 428/914; 400/127

[56] References Cited

U.S. PATENT DOCUMENTS

| | | | |
|---|---|---|---|
| 3,501,302 | 3/1970 | Foltz | 427/12 |
| 3,999,946 | 12/1976 | Patel et al. | 23/253 TP |
| 4,054,684 | 10/1977 | Ceintrey et al. | 427/54.1 |
| 4,215,208 | 7/1980 | Yee et al. | 526/285 |

FOREIGN PATENT DOCUMENTS

| | | | |
|---|---|---|---|
| 966656 | 8/1964 | United Kingdom | 427/146 |

*Primary Examiner*—Norman Morgenstern
*Assistant Examiner*—Janyce A. Bell
*Attorney, Agent, or Firm*—Richard C. Stewart, III; Alan M. Doernberg

[57] ABSTRACT

A printing or reproducing or pressure-detecting process comprising producing on a substrate a surface consisting essentially of a colored acetylenic composition of partially polymerized monomer which has at least two triple bonds which are conjugated, and having certain substituents in the molecule; preferably 5,7-dodecadiyn-1,12-bis(p-bromophenyl urethane) monomer. When subjected to impact or pressure, these surfaces change color sharply; e.g. an orange surface comprising the above bromophenyl urethane monomer, partially polymerized, changes sharply and instantly to blue in those precise areas where struck by a typewriter letter-face.

11 Claims, No Drawings

PROCESS OF PRINTING BY IMPACT AND FOR MARKING AREAS WHERE IMPACT OR PRESSURE IS APPLIED

BACKGROUND OF THE INVENTION

This invention relates to producing a pressure-responsive surface upon paper, metal, plastic and other substrates, especially a surface for printing by application of low to moderate impact or pressure, such as developed by a typewriter letter-face in normal operation or mechanically by a press or the like, or by hand using a stylus or the like pointed rods.

Comparatively little attention has been given in the past to the effects of pressure upon diacetylenic compositions. U.S. Pat. No. 3,501,302 of Mar. 17, 1970 to Foltz discloses certain effects of pressure on certain diacetylenic monomers. Specifically at column 5, line 65 to column 6, line 39 the Foltz patent discloses photo sensitive polyyne compounds which are photopolymerized when irradiated and thereby become colored, usually blue or purple; and change to red on heating or extraction by a solvent. These products are pressure-sensitive in that they become a dark blue when subjected to high pressures such as 10–20 kilobars of pressure (i.e. about 1 to 2 million kPa). Moreover the patent at column 24, lines 1–11 discloses filter paper saturated with an ether solution of 13,15-octacosadiyne and aged about one week, then subjected to slight pressure as by scratching with a stylus or striking with a letter-type face, and immediately thereafter exposed to ultraviolet light. Thereupon that portion of the filter paper at which the scratching or pressure was applied is described as immediately taking on a deep blue coloration. p U.S. Pat. No. 3,999,946 of Dec. 28, 1976 to Patel et al. at column 9, lines 29–42 indicates that the compound 2,4-hexadiyn-1,6-bis(phenyl urethane) changes color at a rate depending on temperature and thus can be used as an indicator of cumulative effects of time/temperature. Moreover, this passage indicates that when said compound is deposited from dioxane solvent, it can be inactivated by subjecting to stress such as exerted by stamping with code numbers, so that the indicator regions under each stamp will be deactivated against further color change, at the time of stamping. (Per Example 1, at first the color is blue, which intensifies; and then, at 40° C. and above, changes to red).

SUMMARY OF THE INVENTION

In accordance with this invention it has been found that the behavior described in the Patel et al. U.S. Pat. No. 3,999,946 above cited does not fully represent the behavior of the cited bisphenyl urethane compound when partially polymerized by heat or ultraviolet light; and then subjected to moderate pressure. Instead, it has been found (see Example 3 below) that the resulting partially polymerized blue composition, upon the surface of a substrate such as paper, when subjected to moderate pressure will instantly form a sharply defined red print at the precise areas where pressure was applied.

More broadly, this invention provides a process for printing by impact, or for marking the precise areas to which low to moderate impact or pressure is applied, comprising:

(1) Producing on a substrate, a surface responsive—by color change—to low to moderate impact or pressure, by the sequence of steps consisting essentially of:

(a) depositing on the substrate—in the crystalline form which becomes colored upon partial polymerization by heating below the melting point for a period of time or exposing to high energy radiation—a crystalline solid consisting essentially of at least one monomeric acetylene compound having at least two triple bonds in the molecule, of which bonds at least two are conjugated, said acetylene compound being doubly terminally substituted by a chain consisting of from one to four methylene diradicals terminated by a radical selected from para-bromophenyl urethane, n-butoxycarbonylmethylene urethane, phenyl urethane, meta-tolylurethane and hydroxy; and (b) partially polymerizing said monomeric acetylene compound to form a composition consisting essentially of 0.1 to 50 weight percent of polymer, the balance of this composition being predominantly the parent acetylene monomer or monomers; said composition irreversibly changing color—without substantial further polymerization—when subjected to low to moderate impact or pressure, at the precise areas where such impact or pressure is applied; and (2) Applying by impact or pressure to selected areas of the resulting surface, a force sufficient to produce a color change in those areas and not greater than can be developed, by hand, at the tip of a sharp pointed rod.

A process wherein the only crystalline solid monomeric acetylene compound which is partially polymerized, is at least one diacetylene compound represents a preferred process in accordance with this invention. In particular the preferred process employs as the diacetylene compound 5,7-dodecadiyn-1,12-bis(p-bromophenyl urethane), hereinafter abbreviated "DoDpBPU".

The preferred acetylenic composition, comprising said pressure-responsive surface, contains 0.5 to 50 weight percent of polymer of 5,7-dodecadiyn-1,12-bis(p-bromophenyl urethane), the balance of said acetylenic composition being predominately the parent monomer; said composition being orange-to-red and turning blue in the areas of the surface where sufficient force is applied thereto via impact or pressure. In particular, we have found, the pressure resulting at said surface from the impact produced by a typewriter letterface in normal operation is sufficient to produce a sharp distinct blue image of the letter-face upon the orange-to-red surface. More generally, with surfaces produced in the process of this invention, a change of color in the areas where a force is applied can be produced by scratching on the surface with a sharp pointed plastic rod.

DETAILED DESCRIPTION

The compositions used in our process upon the surface of a substrate such as paper consist essentially of partially polymerized acetylenes. By "partially polymerized acetylenes" we mean compositions containing up to about 50 weight percent of polymer, which can be obtained by polymerizing, in solid state, crystalline acetylenic monomers by use of thermal annealing, i.e. heating below the melting point, for example in an oven at known temperature; or by exposure to high energy radiation such as ultraviolet rays or gamma rays.

The crystalline form of the acetylenic monomer to be used in our process must be an "active" form, i.e. a form responsive to heat or radiation to polymerize to a colored polymer.

Such "active" forms generally result upon crystallization from solution; but as is known, the activity may be affected by the choice of solvent; so much so that some compounds, for instance the phenyl urethane of Example 3 below, are practically inactive when deposited from solvent such as THF or acetone but are readily polymerized when deposited from p-dioxane, DMF or pyridine. Among solvents found to be useful for the deposition of crystalline monomer in the process of this invention are acetone, THF, nitromethane, dichloromethane, chloroform, p-dioxane, DMF, and pyridine. Mixed solvents can be used, such as mixtures of the above with each other or with nonsolvents, e.g. hexane.

The method of preparing the monomers is described broadly in the above cited U.S. Pat. No. 3,999,946 at column 5, line 59-column 6, line 15. The herein preferred diacetylene compound, DoDpBPU, and its preparation and partial polymerization are disclosed in Yee et al. U.S. Pat. No. 4,215,208 of July 29, 1980 at column 24, line 59-column 25, line 9.

It will be appreciated that in order for the markings produced on the surface bearing the partially polymerized diacetylene to remain sharply visible, it is necessary that the original color of the surface before pressure is applied should not change or at least not change toward the color produced by the exertion of pressure. The colors produced by the exertion of pressure tend toward the colors produced by further polymerization and/or the color produced by further polymerization tends toward darkening. Accordingly, it is desirable for good permanence of the markings obtained, to include a stabilizer to protect the partially polymerized polymer against further polymerization, in particular a stabilizer against ultraviolet light. Ultraviolet absorbers are well known and are suitable for such protection of the partially polymerized polymer, such as in particular 2-hydroxy-4-alkoxybenzophenone, tetramethylpiperidine, and resorcinol monobenzoate.

It will be appreciated that for best results, it is desirable that the partially polymerized polymer should respond with a sharp color transition to relatively low pressures applied to it, such as the pressure due to the force of impact of a typewriter letter-face in normal operation or the pressure due to ordinary writing by hand; but should not respond to much lighter pressures such as might be developed in normal handling of the paper, or other substrate with a surface bearing the partially polymerized polymer. From this point of view, as well as because of the sharp color contrast between orange background and blue markings obtained therewith, the above indicated acetylene compound designated DoDpBPU is the preferred monomer for use in our process.

Depending upon the monomer or monomers used, surfaces prepared in accordance with this invention will show varying responses to a given pressure, and varying minimum pressures at which a clear response is obtained. The substrates having these surfaces have utility in reproducing impressions in response to a low to moderate impact or pressure, e.g. as in printing on original sheets or onto duplicating sheets; and also for detecting pressures developed between two surfaces as where a close fit or a tight seal may be desired.

When "pressure" is referred to herein, it is to be understood that the term, broadly, includes static pressures such as can be applied for example mechanically by a press, or by hand through the tip of a sharp pointed instrument such as a stylus or rod; and also includes the momentary pressures resulting from the force of impact upon a given area, e.g. due to impact by a typewriter letter-face in normal operation.

The responsiveness of the subject compositions to pressure can be varied, not only by choosing different acetylenic compounds for use in the process but also by use of admixed compatible compounds. For example acetylene compounds, above designated, can be cocrystallized with each other or with other acetylene compounds; or cocrystallized compositions or solid solutions can be formed with any desired compatible compound or compounds.

PREPARATIVE PROCEDURE

Synthesis of 5,7-dodecadiyn-1,12-bis (p-bromophenyl urethane), DoDpBPU

In a three-necked flask fitted with a magnetic stirrer, an addition funnel and a thermometer, 9.7 g (0.05 mole) of 5,7-dodecadiyn-1,12 diol, and 300 mL of tetrahydrofuran (THF) were added. Also added was 0.5 g of di-t-butyl-tin-di-2-ethylhexanoate and 0.5 mL of triethylamine, as catalysts. A solution of 25 g (0.125 mole) of p-bromophenylisocyanate in 100 mL of THF was added dropwise from the addition funnel over a period of half an hour. After one hour, hexane was added to precipitate the resulting DoDpBPU.

The precipitate was filtered, and recrystallized from acetone/hexane. The yield was quantitative. M.P. 158° C. by DSC (differential scanning calorimeter). Analysis:

| Elemental, | C, | H, | N, | O, | Br |
|---|---|---|---|---|---|
| found | 52.43 | 4.33 | 4.97 | 11.45 | 23.36 |
| Calculated | 54.74 | 4.56 | 4.91 | 11.23 | 24.56 |

Polymerization

DoDpBPU is a colorless solid monomer. It has two crystallographic phases, one crystallizing e.g. from acetone, THF, nitromethane and the other from p-dioxane. The first partially polymerizes upon thermal annealing, and likewise upon exposure to ultraviolet radiation, to an orange-to-red composition, and the other partially polymerizes likewise to a blue composition. Upon thermal annealing at 140° C. for 7 days and likewise upon irradiating with 50 Mrads of Co-60 gamma ray, both the phases polymerize quantitatively to metallic green-gold polymer. These polymers have the backbone structure

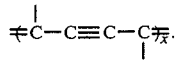

Raman frequencies associated with the backbone in the orange colored polymer are 1472 $cm^{-1}$ (C=C) and 2097 $cm^{-1}$ (C≡C).

POLYMER PROPERTIES

DoDpBPU crystals (about 1 $mm^2$ in area and 0.1 mm thick) grown from acetone/hexane were stored at room temperature for about two years. The crystals turned light orange upon the storage.

The crystals turned violet-blue upon rubbing hard with the thumb or hammering lightly.

A portion of the orange crystals was annealed at 80° C. for ten days. The crystals turned dark red. A portion of these annealed red crystals was pressed into a pellet by applying about 4 tons of pressure per sq. in. (about 540 atm. or 55,000 kPa). The pellet was dark violet (almost black). The polymer conversion was determined by extracting unreacted monomer (see Table 1).

TABLE 1

| Polymer conversion of crystals annealed 80° C. for ten days. | |
|---|---|
| | Polymer Conversion (%) |
| Before Pressure | 9.7 |
| After Pressure (4 tons) | 9.8 |

The results indicate that there is no significant polymerization upon application of pressure. The color change is believed due to a nonplanar-to-planar or to a strained-to-unstrained structural change of the polymer backbone.

Powder X-ray diffraction measurements showed no evidence for the formation of a new, nonisomorphous crystallographic phase by the application of pressure followed by the release of pressure. Also the sample crystallinity is little changed, or unchanged, by this stress cycle.

The melting point of unreacted monomer (about 158° C. by DSC) remains unchanged after the application followed by release of pressure.

EXAMPLE 1

Carbonless Reproduction Paper

A 5% solution of DoDpBPU was prepared in acetone in a 200 mL beaker. A $10\times15$ cm$^2$ filter paper was dipped into the solution and dried in air (a better coating can be obtained by spraying the solution onto the filter paper). The paper was annealed in an oven at 90° C. for 2 hours for partially polymerizing the DoDpBPU. The colorless surface turned light orange upon the thermal annealing. The surface is now responsive to pressure. Typing on that paper with an electric typewriter without ribbon instantly and precisely reproduced the letter-faces in blue. The surface was not affected by normal handling. The pressure exerted by writing in the usual manner with a sharp pointed rod was sufficient to produce blue writing on the orange background.

EXAMPLES 2-6

Several other diacetylenes were coated similarly on filter paper from solvents as noted in Table 2 below, and were partially polymerized to a blue color, either by thermal annealing or by exposure to UV light for a few seconds. The following Table 2 shows the color change which immediately resulted upon scratching the treated paper surface with a plastic rod or hammering lightly on a wedge bearing against the paper surface. (The surfaces in Examples 2 through 6 were found to require higher impact or pressure, to produce a distinct color change, than the pressure resulting from the force of impact of a typewriter letter-face in normal operation).

TABLE 2

| Diacetylene R—C≡C—C≡C—R | | | | |
|---|---|---|---|---|
| Example Number | R | Original Color of Surface | Color in Areas Subjected to Pressure | Solvent Used For Coating |
| 2 | $-(CH_2)_4OCONHCH_2COO(n\text{-}Bu)$ | Blue | Red | Acetone |
| 3 | $-CH_2OCONHC_6H_5$ | Blue | Red | p-Dioxane |
| 4 | $-CH_2OCONHC_6H_4CH_3$(meta-) | Blue | Red | p-Dioxane |
| 5 | $-(CH_2)_3OH$ | Blue | Red | Acetone |
| 6 | $-(CH_2)_3OCONHCH_2COO(n\text{-}Bu)$ | Blue | Violet-Blue (little change) | Acetone |

The color changes produced in Examples 1-6 above were irreversible. Accordingly, it will be recognized that the appearance of the printing or other marking produced by the process of this invention cannot easily be altered.

We claim:

1. Process for printing by impact, or for marking the precise areas to which low to moderate impact or pressure is applied, comprising:

(1) Producing on a substrate, a surface responsive—by color change—to low to moderate impact or pressure, by the sequence of steps consisting essentially of:

(a) depositing on the substrate—in a crystalline form which becomes colored and partially polymerized upon heating below the melting point for a period of time or exposing to high energy radiation—a crystalline solid consisting essentially of at least one monomeric acetylene compound having at least two triple bonds in the molecule, of which bonds at least two are conjugated, said acetylene compound being doubly terminally substituted by a chain consisting of from one to four methylene diradicals terminated by a radical selected from para-bromophenyl urethane, n-butoxycarbonylmethylene urethane, phenyl urethane, metatolyl urethane, and hydroxy; and (b) partially polymerizing said monomeric acetylene compound by said heating or exposing to high energy radiation to form a composition consisting essentially of 0.1 to 50 weight percent of polymer, the balance of said composition being predominantly the parent acetylene monomer or monomers; said composition irreversibly changing color when subjected to low to moderate impact or pressure, at the precise areas where such impact or pressure is applied; and (2) Applying a force, by impact or pressure to areas of the resulting surface, said force not less than that sufficient to produce a color change in said areas, and said force not greater than that which can be developed, by hand, through the tip of a sharp pointed rod.

2. Process of claim 1 wherein the acetylene compound is deposited from a solvent selected from acetone, tetrahydrofuran, nitromethane, dichloromethane, chloroform, p-dioxane, dimethylformamide, pyridine, and mixtures containing the same; and wherein no substantial further polymerization accompanies said change of color.

3. Process of claim 1 wherein at least one diacetylene compound is partially polymerized, becoming blue.

4. Process of claim 1 wherein at least one admixed compatible compound is included in the pressure-responsive surface along with the partially polymerized acetylene compound.

5. Process of claim 4 wherein the acetylene compound is a diacetylene and a compatible compound is cocrystallized therewith.

6. Process of claim 1 wherein an ultraviolet absorber is included with the partially polymerized composition.

7. Process of claim 1 wherein the substrate is paper.

8. Process for printing by impact, or for marking the precise areas to which impact or pressure is applied, comprising in sequence the steps consisting essentially of:

(A) depositing on a substrate the crystalline form of 5,7-dodecadiyn-1,12-bis(p-bromophenyl urethane) monomer which upon heating for a period of time, turns orange-to-red and partially polymerizes to a composition consisting essentially of 0.5 to 50 weight percent of polymer, the balance being predominantly said monomer;

(B) partially polymerizing said bromophenyl urethane monomer by heating, thereby producing orange-to-red coloration of the surface of said substrate;

(C) applying by impact or pressure, to precise areas of the resulting surface, a force which produces a color change to blue in said areas.

9. Process of claim 8 wherein the substrate is paper.

10. Process of claim 9 wherein the force applied is of the order of the force due to impact of a typewriter letter-face in normal operation.

11. Process of claim 8 wherein an ultraviolet absorber is included with the partially polymerized bromophenyl urethane.

* * * * *